US011523490B2

(12) United States Patent
Jindo

(10) Patent No.: US 11,523,490 B2
(45) Date of Patent: Dec. 6, 2022

(54) PLASMA DEVICE, PLASMA GENERATION METHOD

(71) Applicant: FUJI CORPORATION, Chiryu (JP)

(72) Inventor: Takahiro Jindo, Anjo (JP)

(73) Assignee: FUJI CORPORATION, Chiryu (JP)

( * ) Notice: Subject to any disclaimer, the term of this patent is extended or adjusted under 35 U.S.C. 154(b) by 31 days.

(21) Appl. No.: 16/970,561

(22) PCT Filed: Mar. 20, 2018

(86) PCT No.: PCT/JP2018/011148
§ 371 (c)(1),
(2) Date: Aug. 17, 2020

(87) PCT Pub. No.: WO2019/180839
PCT Pub. Date: Sep. 26, 2019

(65) Prior Publication Data
US 2021/0120657 A1 Apr. 22, 2021

(51) Int. Cl.
*H05H 1/24* (2006.01)
*H05H 1/36* (2006.01)

(52) U.S. Cl.
CPC ..... *H05H 1/2406* (2013.01); *H05H 1/36* (2013.01)

(58) Field of Classification Search
None
See application file for complete search history.

(56) References Cited

U.S. PATENT DOCUMENTS 7,453,191 B1 * 11/2008 Song ..... H01J 37/32825 315/111.21
8,263,178 B2 * 9/2012 Boulos ..... H05H 1/2406 315/111.21
8,338,317 B2 * 12/2012 Engelhardt ..... H01L 21/02203 257/632
8,859,056 B2 * 10/2014 O'Neill ..... C09J 5/02 427/207.1
8,883,027 B2 * 11/2014 Yoon ..... H01L 21/31116 156/345.43

(Continued)

FOREIGN PATENT DOCUMENTS

CN 106698385 A 5/2017
JP 2005-56647 A 3/2005

(Continued)

OTHER PUBLICATIONS

International Search Report dated May 22, 2018 in PCT/JP2018/011148 filed on Mar. 20, 2018, 3 pages.

*Primary Examiner* — Srinivas Sathiraju
(74) *Attorney, Agent, or Firm* — Oblon, McClelland, Maier & Neustadt, L.L.P.

(57) ABSTRACT

The object of the present disclosure is to efficiently generate plasma. In the plasma device of the present disclosure, a dielectric barrier discharger and an arc discharger are included, but the arc discharger is provided downstream from the dielectric barrier discharger in a discharge space where a gas for generating plasma is supplied. Dielectric barrier discharge occurs at the dielectric barrier discharger, and arch discharge occurs at the arc discharger. As a result of the gas for generating plasma being activated in the dielectric barrier discharge, the aforementioned gas can be adequately converted to plasma in the arc discharger.

9 Claims, 6 Drawing Sheets

(56) References Cited

U.S. PATENT DOCUMENTS

| | | | | |
|---|---|---|---|---|
| 9,064,674 | B2 * | 6/2015 | Ouyang | H01J 37/32009 |
| 9,255,330 | B2 * | 2/2016 | Vangeneugden | D06M 10/025 |
| 9,284,210 | B2 * | 3/2016 | Boughton | H01J 37/3211 |
| 9,550,694 | B2 * | 1/2017 | Boughton | C03B 5/025 |
| 9,693,441 | B2 * | 6/2017 | Patelli | H05H 1/2406 |
| 10,167,220 | B2 * | 1/2019 | Boughton | C03C 3/145 |
| 10,167,556 | B2 * | 1/2019 | Ruzic | H05H 1/30 |
| 10,446,373 | B2 * | 10/2019 | Zimmerman | H05H 1/50 |
| 10,690,728 | B2 * | 6/2020 | Jindo | G01R 31/1272 |
| 10,709,007 | B2 * | 7/2020 | Gomaa | H05H 1/48 |
| 10,734,194 | B2 * | 8/2020 | Jindo | H01J 37/3244 |
| 10,752,994 | B2 * | 8/2020 | Ruzic | C23C 14/0021 |
| 10,879,047 | B2 * | 12/2020 | Jindo | H01J 37/32458 |
| 11,034,582 | B2 * | 6/2021 | Rodan | C01B 13/11 |
| 11,051,389 | B2 * | 6/2021 | Kim | A61N 5/0624 |
| 2005/0211685 | A1 | 9/2005 | Blankenship | |
| 2011/0108539 | A1 * | 5/2011 | Grabau | H05H 1/2406 219/260 |
| 2013/0284588 | A1 * | 10/2013 | Malik | B01D 53/323 204/164 |
| 2016/0295676 | A1 * | 10/2016 | Patelli | H05H 1/2406 |
| 2017/0339776 | A1 | 11/2017 | Knoll et al. | |
| 2019/0246482 | A1 * | 8/2019 | Zimmerman | H01J 37/32568 |
| 2021/0120657 | A1 * | 4/2021 | Jindo | H05H 1/48 |
| 2021/0166919 | A1 * | 6/2021 | Takikawa | H01J 37/32568 |

FOREIGN PATENT DOCUMENTS

| | | | |
|---|---|---|---|
| JP | 2006-216468 | A | 8/2006 |
| JP | 2013-122215 | A | 6/2013 |
| WO | WO 2016/071680 | A1 | 5/2016 |
| WO | WO 2018/189174 | A1 | 10/2018 |

* cited by examiner

PLASMA DEVICE, PLASMA GENERATION METHOD

TECHNICAL FIELD

The present disclosure relates to a plasma device and plasma generation method for generating plasma.

BACKGROUND ART

Patent Literature 1 describes a plasma device provided with electrodes in the form of a pair of flat plates; a discharge space, provided between the pair of electrodes, to which process gas is supplied; and a dielectric object covering each of the electrodes. In this plasma device, discharge is generated between the pair of electrodes whereby the process gas supplied to the discharge space is converted into plasma, thus, generating plasma.

PATENT LITERATURE

Patent Literature 1: JP-B-4833272

BRIEF SUMMARY

Technical Problem

The object of the present disclosure is to efficiently generate plasma.

Solution to Problem

The plasma device of the present disclosure includes a dielectric barrier discharger and an arc discharger, and the arc discharger is provided downstream from the dielectric barrier discharger in a discharge space to which a gas for generating plasma is supplied. Dielectric barrier discharge occurs at the dielectric barrier discharger, and arch discharge occurs at the arc discharger. As a result of the gas for generating plasma being activated at the dielectric barrier discharge, the gas for generating plasma can be adequately converted to plasma at the arc discharger.

Discharge refers to a high electric field being generated in a space between a pair of electrodes to cause dielectric breakdown (a state in which molecules of a gas are ionized and the amount of electrons and ions is increased) in the gas in the space between the pair of electrodes so that current flows between the pair of electrodes. A dielectric barrier discharge refers to a discharge through a dielectric object (not including gases) generated when an AC voltage is applied to a pair of electrodes, and an arc discharge refers to a discharge that does not pass through a dielectric substance. Charge is stored in the dielectric object in dielectric barrier discharge, but when the polarity is reversed, the stored charge is released, causing discharge to occur. Further, the dielectric object also restricts the current flowing between the pair of electrodes. Therefore, arc discharging does not occur in dielectric barrier discharge, and a large amount of energy is not imparted to the gas in the discharge space. Further, when a high-frequency AC voltage is applied to the pair of electrodes, the polarity inversion speed becomes fast thereby making it possible to continuously discharge. Also, in arc discharge, no restrictions are applied to the current flowing between the pair of electrodes. Therefore, a large current flows between the pair of electrodes, and a large energy is imparted to the gas in the space.

BRIEF DESCRIPTION OF DRAWINGS

FIG. 4 A perspective view of a dielectric enclosure member, which is a constituent member of the plasma device, wherein

DESCRIPTION OF EMBODIMENTS

Hereinafter, a plasma device of the present disclosure will be described with reference to the drawings. In the present plasma device, a plasma generation method according to the present disclosure is implemented. The present plasma device generates plasma at atmospheric pressure.

EMBODIMENTS

Figure 1:
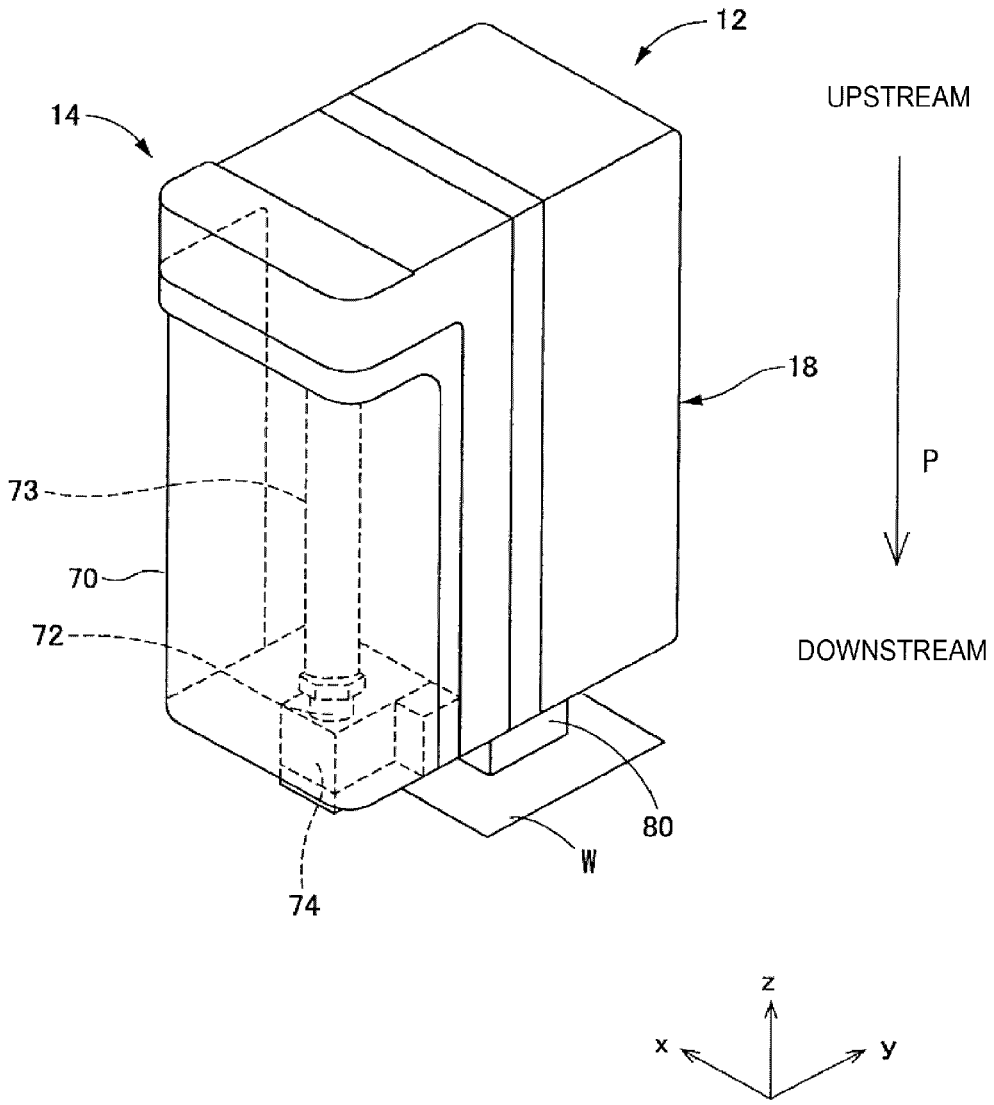
FIG. 1 A perspective view of a plasma device of an embodiment of the present disclosure. In the present plasma device, a plasma generation method which is an embodiment of the present disclosure is implemented.
Figure 6:
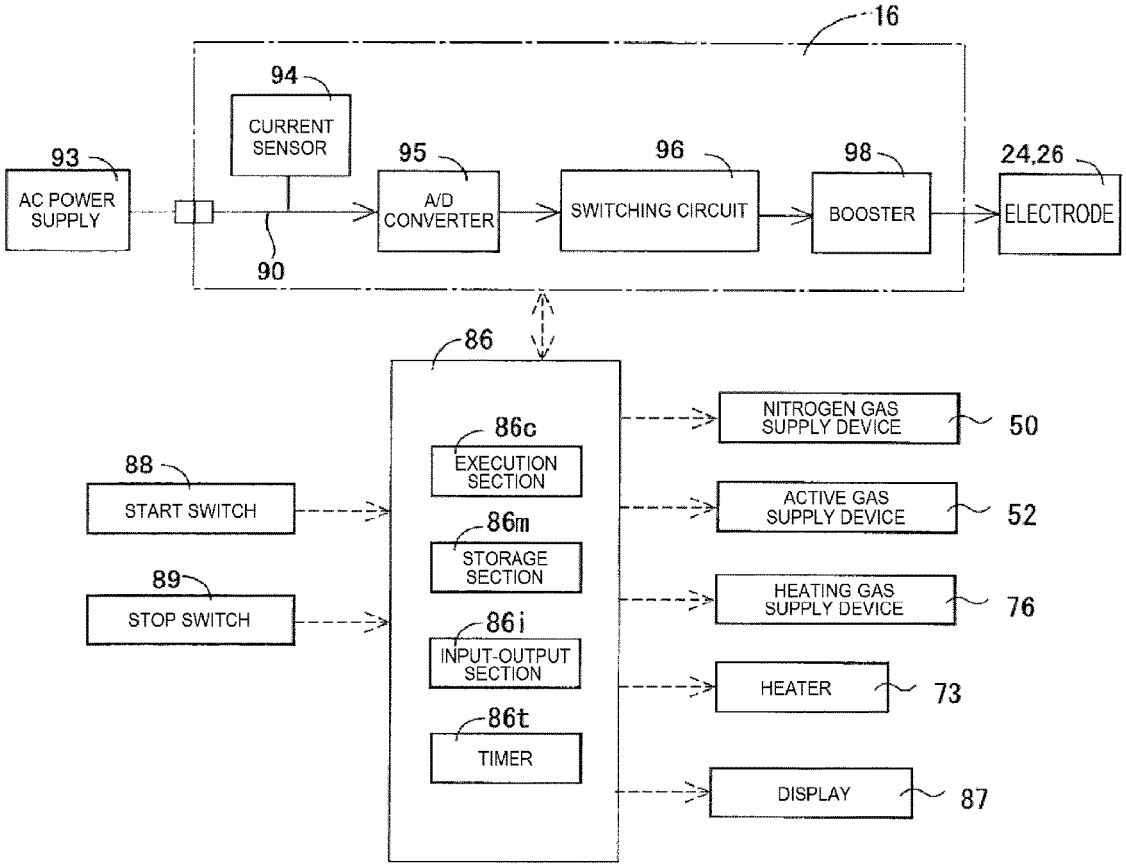
FIG. 6 A view conceptually showing the environment around the power supply device of the plasma device.

Plasma device of FIG. 1 includes plasma generator 12, heating gas supply section 14, power supply device 16 shown in FIG. 6, and the like. Plasma generator 12 and heating gas supply section 14 are provided side by side. Plasma generator 12 generates plasma 12 by converting supplied process gas to plasma. Heating gas supply section 14 supplies heated gas to plasma generator 12, the heated gas having been obtained by heating. In this plasma device, the plasma generated by plasma generator 12 is outputted together with the heating gas supplied by heating gas supply section 14 and irradiated to process target W. In FIG. 1, process gas is supplied and plasma is outputted in the direction of arrow P.

Figure 2:
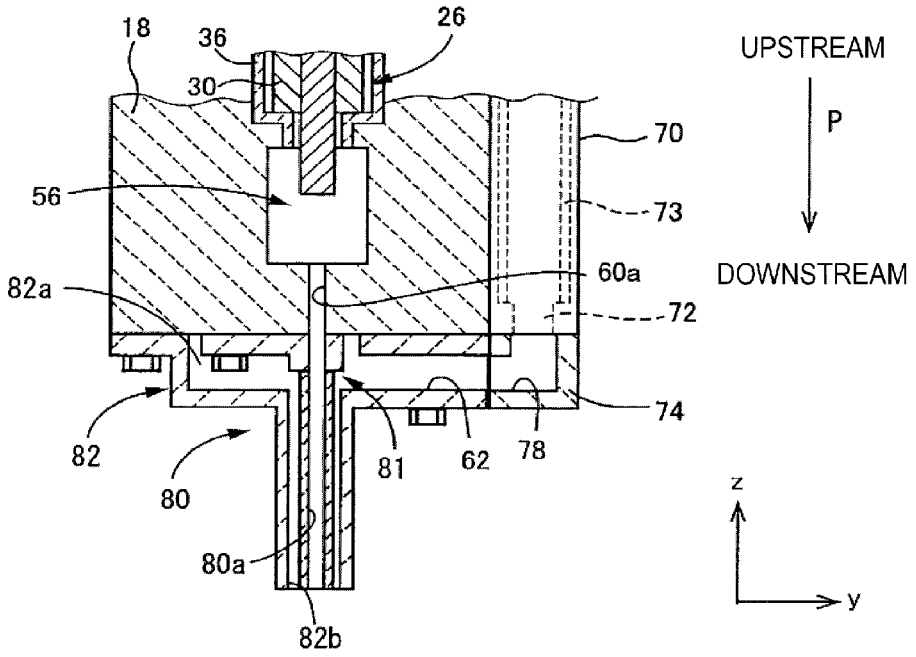
FIG. 2 A cross-sectional view of a portion of the plasma device.
Figure 3:
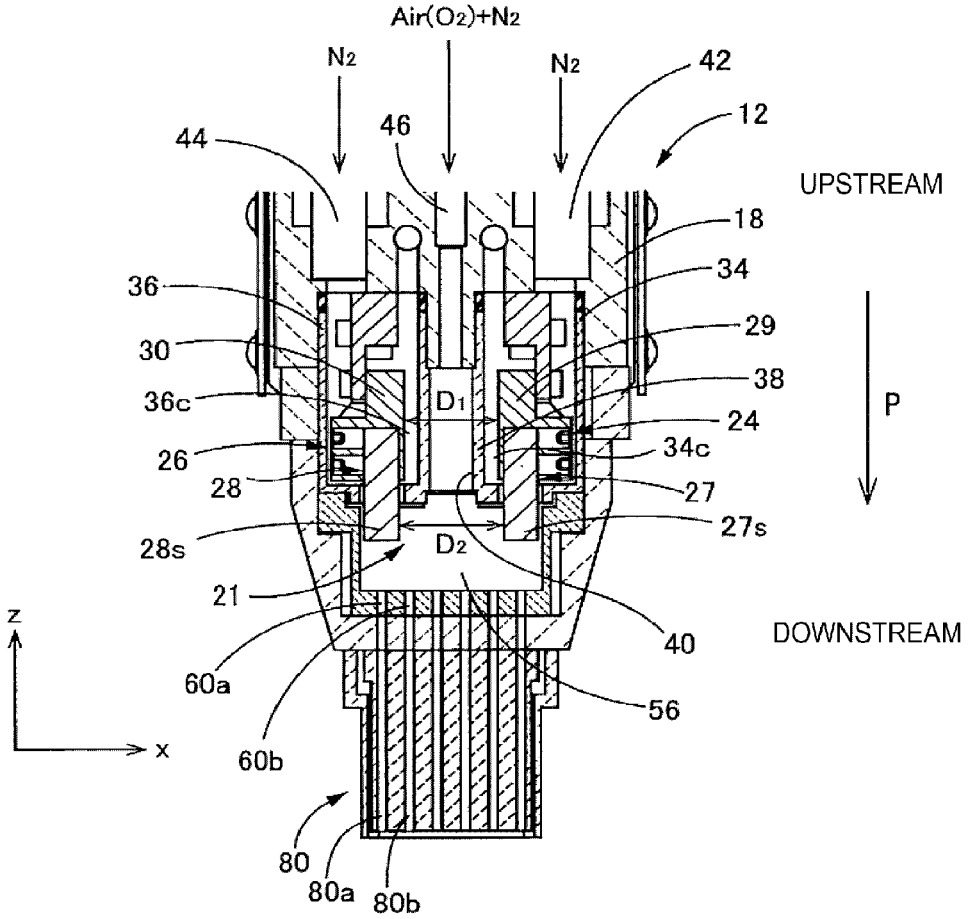
FIG. 3 A cross-sectional view of a portion of the plasma device including a portion of FIG. 2.

As shown in FIGS. 2 to 4, plasma generator 12 includes generator main body 18 consisting of an insulator such as ceramic, a pair of electrodes 24,26, dielectric enclosure member 22, and the like. Generator main body 18 generally extends in the longitudinal direction, and the pair of electrodes 24,26 are held spaced apart in the width direction. Further, between the pair of electrodes 24,26 of generator main body 18 is discharge space 21 to which process gas is supplied in the P-direction.

Hereinafter, in the present plasma device, the width direction of generator main body 18, that is, the direction in which the pair of electrodes 24,26 (hereinafter, "the pair" is omitted and will be simply referred to as electrodes 24,26 or multiple electrodes 24,26, and the same shall apply to other terms) are aligned is the x-direction; the direction in which plasma generator 12 and heating gas supply section 14 are aligned is the y-direction; and the longitudinal direction of generator main body 18 is the z-direction. The z-direction is the same as the P-direction, the side where the processing gas is supplied is the upstream side, and the side where the plasma is outputted is the downstream side. Note that the x-direction, the y-direction, the z-direction are orthogonal to each other.

Each of multiple electrodes 24,26 has a longitudinally elongated shape and each electrode has a pair of electrode rods 27,28 and a pair of electrode holders 29,30. Each of multiple electrode holders 29,30 are larger in diameter than multiple electrode rods 27,28 and electrode rods 27,28 are held and fixed eccentrically with respect to electrode holders 29,30. Further, while each of electrode rods 27,28 is held by electrode holders 29,30, respectively, a part of electrode rods 27,28 protrudes from electrode holders 29,30. Electrodes 24,26 (i.e., electrode holders 29,30 and electrode rods 27,28), extend in the z-direction, that is, the same direction as supply direction P of the process gas, and generator main body 18 holds electrode holders 29,30 and electrode rods 27,28 in an orientation in which electrode holders 29,30 are positioned upstream and electrode rods 27,28 are positioned downstream. Further, the x-direction in which electrodes 24,26 are spaced apart from each intersects the z-direction (P) in which process gas is supplied. Distance D1 between electrode holders 29,30 is smaller than distance D2 between electrode rods 26,27 (D1<D2).

Each of electrode holders 29,30 is made of a conductive material and is functioning as an electrode. Electrode rods 27,28 are fixed to electrode holders 29,30, respectively, such that current can pass between them. In other words, electrode holders 29,30 and electrode rods 27,28 are provided in an electrically continuous state. Further, electrodes 24,26 are held in generator main body 18 and, while connected to power supply device 16, a voltage is applied to both electrode rods 27,28 and electrode holders 29,30 so that both electrode rods 27,28 and electrode holders 29,30 act as electrodes.

Thus, since electrode holders 29,30 and electrode rods 27,28 are respectively provided in an electrically continuous manner, it is sufficient to connect power supply device 16 to any one of electrode holder 29,30 and electrode rods 27,28 to simplify the wiring. An AC voltage of any magnitude and frequency is applied to electrode rods 27,28 and electrode holders 29,30.

Figure 4A:
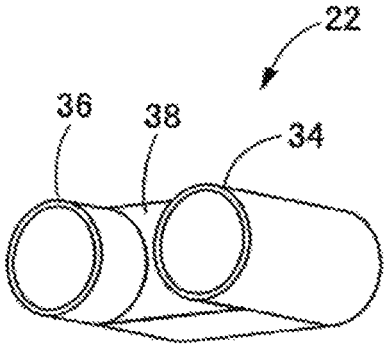
FIGS. 4A, 4B, and 4C are perspective views of the dielectric enclosure member when viewed from different angles.
Figure 4B:
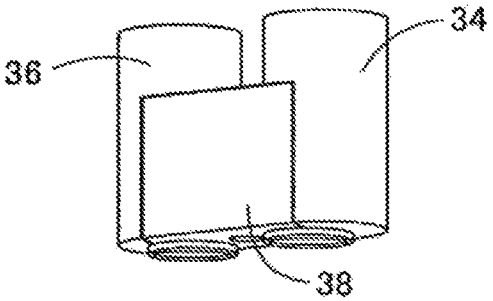
Figure 4C:
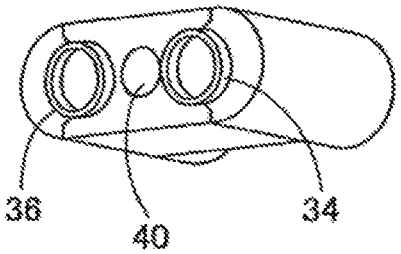

Dielectric enclosure member 22 covers the outer periphery of electrode holders 29,30, and is made of a dielectric (can also be referred to as an insulator) such as ceramic. Dielectric enclosure member 22 has a pair of electrode covers 34,36 spaced apart from each other and connecting portion 38 connecting the pair of electrode covers 34,36, as shown in FIGS. 4A to 4C.

Each of multiple electrode covers 34,36 has a generally hollow cylindrical shape with both ends open in the longitudinal direction. Electrode covers 34,36 are disposed in an orientation such that its longitudinal direction extends in the z-direction and electrode holders 29,30 are mainly disposed while positioned on the inner peripheral side of electrode covers 34,36. Gaps are provided between the inner peripheral surface of electrode covers 34,36 and the outer peripheral surface of electrode holders 29,30, respectively, and these gaps are gas passages 34*c*, 36*c* to be described later. Further, downstream end portions 27*s*, 28*s* of electrode rods 27,28, which are downstream end portions protruding from electrode holders 29,30 described above, protrude from openings on the downstream side of electrode covers 34,36.

Gas passage 40 penetrates connecting portion 38 in the z-direction. In this embodiment, as shown in FIG. 3, the peripheral wall forming gas passage 40 of connecting portion 38 is integrally formed with electrode covers 34,36. There is no member made of a dielectric (not including gases, and the same will apply hereinafter) inside gas passage 40. In other words, there is no member made of a dielectric different from dielectric enclosure 22 between the portions of electrode covers 34,36 facing each other.

On the upstream side of the portion where electrodes 24,26 of generator main body 18 are held, multiple gas passages 42,44,46 and the like are formed. Gas passages 42,44 are connected to nitrogen gas supply device 50 shown in FIG. 6, and gas passage 46 is connected to nitrogen gas supply device 50 and active gas supply device 52 for supplying dry air which is an active gas (including active oxygen). Nitrogen gas supply device 50 includes a nitrogen gas source and a flow rate adjusting mechanism, and can supply nitrogen gas at a desired flow rate. Active gas supply device 52 includes an active gas source and a flow rate adjusting mechanism and can supply active gas at a desired flow rate. In this embodiment, it is assumed that the process gas includes active gas supplied from active gas supply device 52 and nitrogen gas supplied from nitrogen gas supply device 50 (which is an example of an inert gas)

At gas passages 42,44, respectively, gas passages 34*c*,36*c* inside electrode covers 34,36 described above communicate with openings on the upstream side of electrode covers 34,36. Nitrogen gas is supplied to each of gas passages 34*c*,36*c* in the P direction.

Gas passage 40 formed in dielectric enclosure member 22 communicates with gas passage 46. Process gas containing nitrogen gas and active gas is supplied to gas passage 40 in the P direction.

In generator main body 18, discharge chamber 56 is formed between downstream end portions 27*s*, 28*s* of the pair of electrode rods 27,28 protruding from electrode covers 34,36, and downstream from discharge chamber 56, multiple (six in this embodiment) plasma passages 60*a*, 60*b* . . . are formed in a way such that the plasma passages are extending in the z-direction and aligned in the x-direction spaced apart from each other. The upstream ends of multiple plasma passages 60*a*, 60*b* . . . each open to discharge chamber 56. Further, multiple nozzles 80,83 and the like, all being of different types from each other, are detachably attached to the downstream end of generator main body 18. Nozzles 80,83 and the like are made of an insulator such as ceramic. In this embodiment, discharge space 21 is formed by discharge chamber 56, gas passage 40, and the like.

Heating gas supply section 14, as shown in FIGS. 1 and 2, includes protective cover 70, gas pipe 72, heater 73, connecting portion 74, and the like. Protective cover 70 is attached to generator main body 18 of plasma generator 12. Gas pipe 72 is disposed to extend in the z-direction in the interior of protective cover 70, and heating gas supply device (refer to FIG. 5) 76 is connected to gas pipe 72. Heating gas supply device 76 includes a heating gas source and a flow rate adjustment section, and supplies heating gas at a desired flow rate. The heating gas may be an active gas such as dry air or an inert gas such as nitrogen. Further, heater 73 is disposed on the outer peripheral side of gas pipe 72 and heats gas pipe 72, causing the heating gas flowing through gas pipe 72 to get heated.

Connecting portion 74 connects gas pipe 72 to nozzle 80 and includes heating gas supply passage 78 which is generally L-shaped in side view. With nozzle 80 attached to generator main body 18, one end of heating gas supply passage 78 communicates with gas pipe 72 and the other end communicates with heating gas passage 62 formed in nozzle 80.

Nozzle 80, as shown in FIGS. 2 and 3, consists of passage structure 81, having multiple plasma output passages 80*a*, 80*b* . . . (six in the present embodiment) provided in parallel to each other, and nozzle main body 82. Passage structure 81 and nozzle body 82 are both installed on generator main body 18 with passage structure 81 positioned inside housing chamber 82*a* formed in nozzle body 82, causing nozzle 80 to be installed on generator main body 18. As a result, plasma passages 60*a*, 60*b* . . . and plasma output passages 80*a*, 80*b* . . . respectively communicate with each other while nozzle 80 is installed on generator main body 18. Further, heating gas is supplied through gas passage 62 in the gap between housing chamber 82*a* and passage structure 81 of nozzle body 82. Plasma or the like and heated gas are outputted from opening 82*b* at the end of housing chamber 82*a* of nozzle body 82 of nozzle 80.

Figure 5:
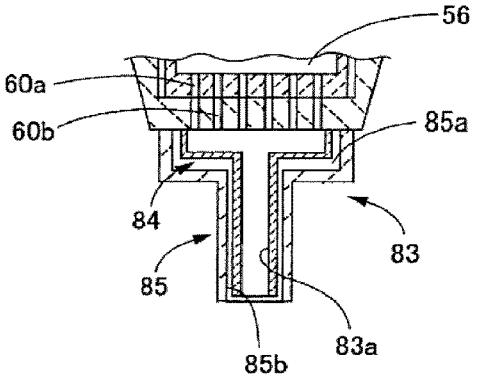
FIG. 5 A cross-sectional view of a nozzle that can be attached to or detached from the plasma device.

Nozzle 83, shown in FIG. 5, which is different from nozzle 80, can also be installed on generator main body 18. One plasma output passage 83*a* is formed on passage structure 84 of nozzle 83. Further, passage structure 84 and nozzle body 85 are installed on generator main body 18 with passage structure 84 positioned in housing chamber 85*a* formed inside nozzle body 85. As a result, multiple plasma passages 60*a*, 60*b* . . . and plasma output passage 83*a* communicate respectively with each other while nozzle 80 is installed on generator main body 18. Further, heating gas is supplied to the gap between housing chamber 85*a* and passage structure 84 of nozzle body 85, and plasma and the like and heating gas is outputted from opening 85*b* at the distal end of housing chamber 85*a*.

The plasma device includes computer-based control device 86, as shown in FIG. 6. Control device 86 includes execution section 86*c*, storage section 86*m*, input-output section 86*i*, timer 86*t*, and the like, and input-output section 86*i* is connected to nitrogen gas supply device 50, active gas supply device 52, heating gas supply device 76, heater 73, power supply device 16, display 87, and the like and is also connected to start switch 88, stop switch 89, and the like. The state of the plasma device is displayed on display 87.

Start switch 88 is a switch which is operated when instructing the driving of the plasma device, and stop switch 89 is a switch which is operated when instructing the stopping of the plasma device. For example, by connecting power cable 90 of the present plasma device to an outlet and turning on a breaker (not shown), the present plasma device, AC voltage can be supplied from commercial AC power source 93 to start operation of control device 86 is started. In this way, the plasma device is switched from a non-drivable state in which the drive is disabled to a drivable state in which the drive is enabled. In the drivable state, the driving of the plasma device is started by the ON operation of start switch 88, and the driving of the plasma device for plasma generation is stopped by the ON operation of stop switch 89 during the driving of the plasma device. That is, when the ON operation of stop switch 89 is enacted, the application of voltage to electrodes 24,26 is not performed, and heating of heating gas is also not performed, but the operation of a cooling device (not shown) or the like may be started.

Power supply device 16 includes power supply cable 90, current sensor 94, A/D converter 95, switching circuit 96, booster 98, and the like. With power supply cable 90 connected to an electrical outlet, AC voltage supplied from commercial AC power supply 93 is converted to direct current voltage in A/D converter 95 and PWM (Plus Width Modulation) control is implemented by switching circuit 96. A pulse signal of a voltage of a desired frequency, obtained by PWM control, is boosted by booster 98 and applied to electrodes 24,26. Further, the alternating current flowing through power supply device 16 is detected by current sensor 94.

Figure 7:
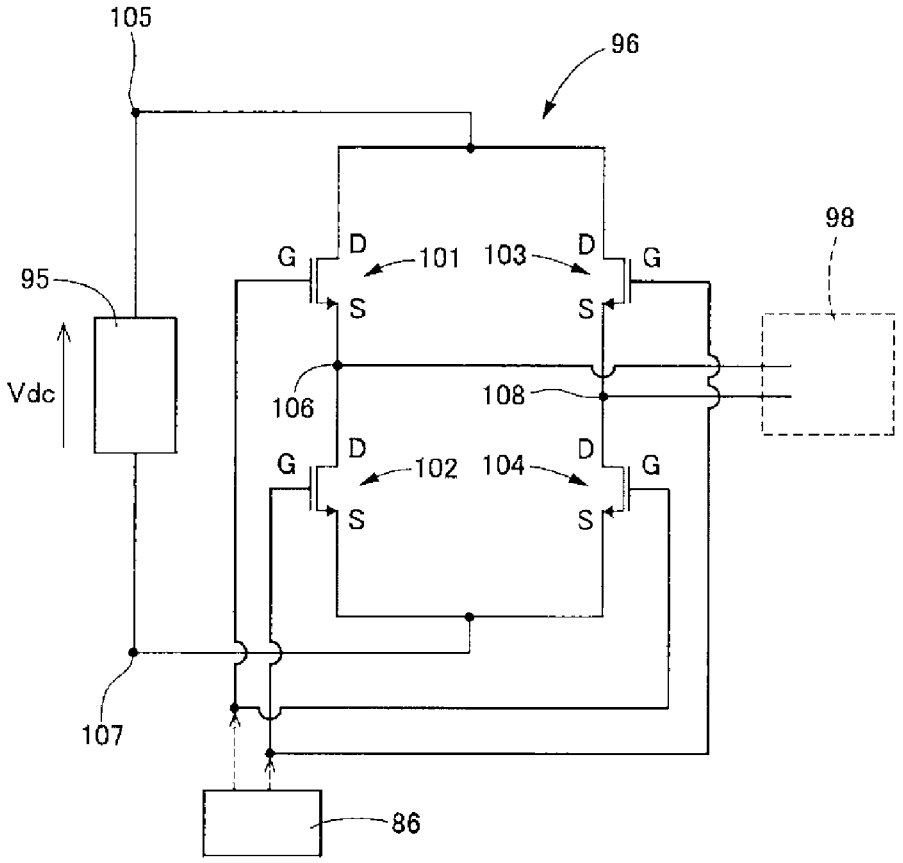
FIG. 7 A view showing a switching circuit of the power supply device.

Switching circuit 96, as shown in FIG. 7, is constituted by a bridge connection of the first to fourth of four switching elements 101 to 104. In this embodiment, a MOSFET device is used as a switching element. For first switching element 101, drain D is connected to high-voltage terminal 105 of the output of A/D converter 95, and source S is connected to first output terminal 106. For second switching element 102, drain D is connected to first output terminal 106, and source S is connected to low-voltage terminal 107 of A/D converter 95. For third switching element 103, drain D is connected to high-voltage terminal 105 of A/D converter 95, and source S is connected to second output terminal 108. For fourth switching element 104, drain D is connected to second output terminal 108, and source S is connected to low-voltage terminal 107 of A/D converter 94.

First output terminal 106 and second output terminal 108 are inputted to booster 98 via a smoothing circuit (not shown). Gate G of first switching element 101 and gate G of fourth switching element 104, and gate G of second switching element 102 and gate G of third switching element 103 are respectively bundled together and connected to the input and output portions of control device 86. First to fourth switching elements 101-104 conduct electricity between drain D and source S only when a control signal is inputted to gate G. In the case where an ON signal is inputted to gate G of first switching element 101 and fourth switching element 104, and in the case where an ON signal is inputted to gate G of second switching element 102 and third switching element 103, the direction of the current is reversed.

The plasma device configured as described above is driven by the ON operation of start switch 88. Through the control of switching circuit 96, an AC voltage of 2 kHz or more is applied to electrodes 24,26 from power supply device 16, for example, an AC voltage from 8 kHz to 9 kHz can be applied. Further, nitrogen gas is supplied to gas passages 34*c*,36*c* at a desired flow rate, and process gas is supplied to discharge space 21 at a desired flow rate. Further, heated gas is supplied to heating gas passage 62.

Although process gas is supplied to discharge space 21 in the P direction, dielectric barrier discharge occurs through electrode covers 34,36 between the pair of electrode holders 29,30 upstream from gas passage 40, and arc discharge occurs between downstream end portions 27*s*, 28*s* of the pair of electrode rods 27,28 in discharge chamber 56 downstream from where the dielectric barrier discharge occurs.

Although charges are stored in electrode covers 34,36 during dielectric barrier discharge by applying an AC voltage to electrode holders 29,30, when polarity is reversed, the stored charge is released, thereby causing a discharge to occur. Further, the current flowing between electrode holders 29,30 is restricted by electrode covers 34,36. Therefore, it is not normal for dielectric barrier discharge to lead to arc discharge, but it is normal that a large amount of energy is not imparted to the process gas in dielectric barrier discharge. Further, in this embodiment, since high-frequency AC voltage is applied to electrode holders 29,30, the polarity inversion speed is increased, making it possible to adequately discharge.

In contrast, in arc discharge, a large current flows between downstream end portions 27*s*, 28*s* of the pair of electrode rods 27,28 and a large amount of energy is imparted to the process gas.

Thus, in dielectric barrier discharge, since the energy imparted to the process gas is small, the process gas is ionized but not always converted to plasma. However, the process gas is brought to a high energy potential, that is, the process gas is excited or heated. Thereafter, since a large amount of energy is imparted to the process gas, the process gas which has not been converted to plasma in the dielectric barrier discharge can be adequately converted to plasma in the arc discharge. Further, since process gas that has been subjected to the dielectric barrier discharge is already in a state of high energy potential, the process gas is even more adequately converted to plasma as a result of undergoing arc discharge. It should be noted that the discharge between both the portion between the pair of electrode holders 29,30 and the portion between downstream end portions 27*s*, 28*s* of the pair of electrode rods 27,28 of discharge space 21 are confirmed by light being generated.

Figure 8:
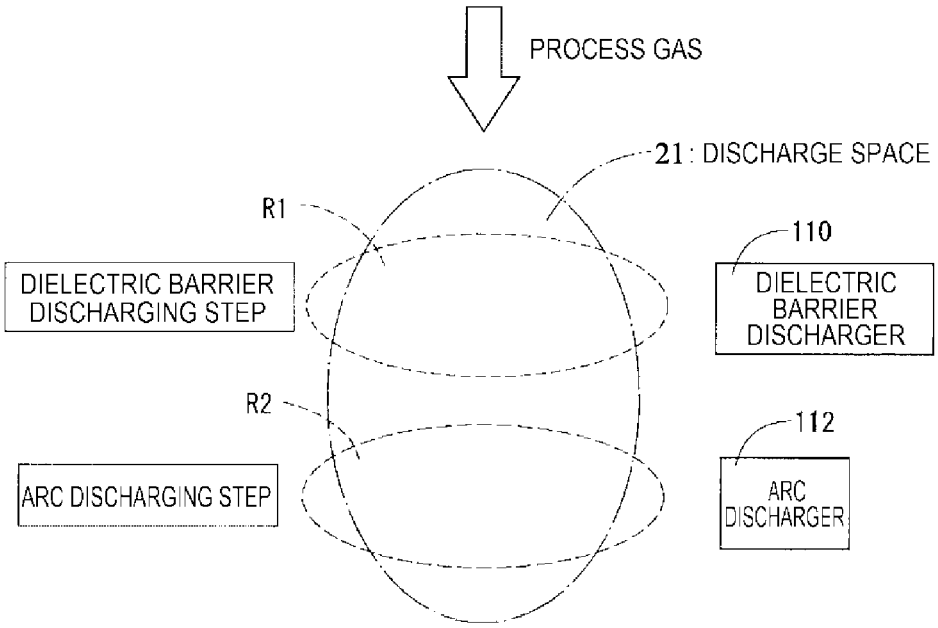
FIG. 8 A view conceptually showing the operation of the plasma device.

Thus, in the present embodiment, as shown in FIG. 8, since dielectric barrier discharge region R1 is provided upstream from discharge space 21 and arc discharge region R2 is provided downstream from discharge space 21, generation of plasma is carried out in two stages of imparting energy to process gas through dielectric barrier discharge (dielectric barrier discharging step) and imparting energy to process gas through arc discharge (arc discharging step). As a result, the process gas can be efficiently converted to plasma. Further, it is therefore possible to stably increase the concentration of plasma irradiated to a processing target and adequately perform plasma processing on the processing target.

Figure 9:
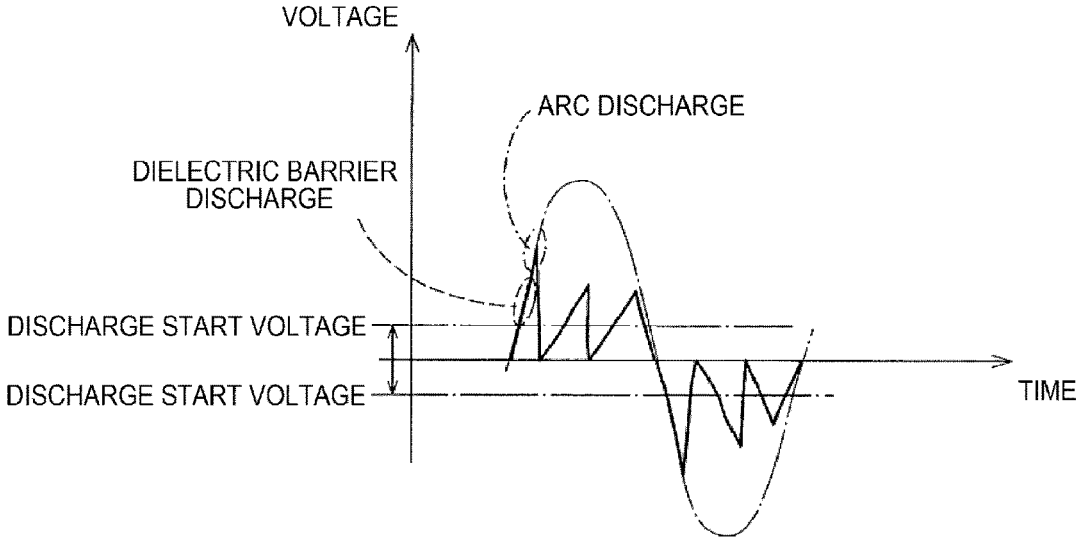
FIG. 9 A figure showing the voltage during operation of the plasma device.

In FIG. 9, the change in voltage during operation of the present plasma device is shown in a simplified format. As shown by the solid line in FIG. 9, when the voltage applied to electrodes 24,26 increases and exceeds the discharge start voltage, dielectric barrier discharge occurs, and after that, when the voltage is further increased and arc discharge occurs, the circuit gets shorted and the voltage becomes 0. In the present embodiment, it is believed that dielectric barrier discharge and arc discharge occur about 4-8 times per cycle of alternating current.

Further, members made of a dielectric are provided inside of gas passage 40. Further, the spacing between electrode holders 29,30 is smaller than the spacing between electrode rods 27,28, that is, downstream end portions 27*s*, 28*s*. Thus, it is easy to cause a dielectric barrier discharge between electrode holders 29, 30.

Furthermore, since the direction in which electrode holders 29,30 extend and the supply direction of the process gas are the same, it is possible to expand the size of dielectric barrier discharge region R1, thereby enabling conversion of the process gas to plasma.

As described above, in this embodiment, electrode holders 29,30 correspond to first electrodes, electrode rods 27,28 correspond to second electrodes, and electrode covers 34,36 correspond to dielectric barriers. Further, dielectric barrier discharger 110 (refer to FIG. 8) is configured by electrode holders 29,30, electrode covers 34,36, gas passage 40, and the like, and arc discharger 112 (refer to FIG. 8) is configured by downstream end portions 27*s*, 28*s* of electrode rods 27,28, discharge chamber 56, and the like. Further, nitrogen gas supply device 50, active gas supply device 52, and the like constitute a process gas supply device. It should be noted that electrode holders 29,30 correspond to a pair of electrodes of claim 9, electrode covers 34,36 correspond to a pair of dielectric objects, and power supply device 16 corresponds to a high-frequency power supply.

Note that in the above embodiment it is assumed that the process gas which is a gas for generating plasma contains dry air containing active oxygen and nitrogen gas, but the type of the process gas is not limited to this. Further, although one pair of electrodes 24,26 are provided in the above embodiment, multiple pairs of electrodes can be provided. Furthermore, although electrode covers 34,36 were intended to serve as a dielectric barrier to cover the outer periphery of electrode holders 29,30, it is not necessary for the dielectric barrier to have a shape that covers the outer periphery of electrode holders 29,30 provided the dielectric barrier is positioned between the portions of electrode holders 29,30 facing each other. Further, the present disclosure can be implemented in a form other than that described in the above embodiment in which various modifications and improvements are made based on the knowledge of a person skilled in the art, such as a modification in which heating gas supply section 14 is not indispensable.

REFERENCE SIGNS LIST

12: Plasma generator, 21: Discharge space, 22: Dielectric enclosure member, 24,26: Electrodes, 27,28: Electrode rods, 27*s*, 28*s*: Downstream end portions, 29, 30: electrode holder, 34,36: Electrode covers, 34*c*,36*c*: Gas passages, 40: gas passages 42,44,46: Gas passages, 50: Nitrogen gas supply device, 52: Active gas supply device, 56: Discharge chamber, 86: Control device, 96: Switching circuit, 110: Dielectric barrier discharger, 112: Arc discharger

The invention claimed is:

1. A plasma device, comprising:

a discharge space in which process gas flows, the process gas being a gas for generating plasma;

a dielectric barrier discharger configured to perform dielectric barrier discharge on the process gas in the discharge space, the dielectric barrier discharger includes first electrodes which are a pair of electrode holders:

a dielectric enclosure member that covers an outer periphery of the electrode holders; and an arc discharger configured to perform arc discharge on the process gas and provided downstream from the dielectric barrier discharger in a direction in which the process gas in the discharge space flows, the arc discharger includes second electrodes which are a pair of electrode rods, wherein the pair of electrode rods are held respectively by the pair of electrode holders so that the first electrodes and the second electrodes are electrically continuous, wherein the discharge space includes a gas passage formed in the dielectric enclosure member, wherein the dielectric barrier discharge occurs through the dielectric enclosure member between the pair of electrode holders upstream from the gas passage, and wherein arc discharge occurs between downstream end portions of the pair of electrode rods in a discharge chamber downstream from where the dielectric barrier discharge occurs in the direction in which the process gas in the discharge space flows.

2. The plasma device of claim 1, wherein the pair of first electrodes extend in the direction of flow of the process gas and are spaced apart from each other in a direction intersecting the direction of flow of the process gas;

the pair of second electrodes extend in the direction of flow of the process gas and are spaced apart from each other in the direction intersecting the direction of flow of the process gas.

3. The plasma device of claim 2, wherein the distance between the pair of first electrodes is less than the distance between the pair of second electrodes.

4. The plasma device of claim 2, wherein the dielectric barrier discharger comprises a dielectric barrier disposed between the pair of first electrodes.

5. The plasma device of claim 4, wherein the dielectric barrier is composed of a pair of electrode covers covering each of the pair of first electrodes, and there is no member made of dielectric between the pair of electrode covers.

6. The plasma device of claim 2, wherein the plasma device further comprises a power supply device configured to apply an AC voltage to each of the pair of first electrodes.

7. The plasma device of claim 1, wherein the plasma device further comprises a process gas supply device configured to supply the process gas to the discharge space.

8. A plasma generation method comprising:

a dielectric barrier discharging step of performing dielectric barrier discharge with a pair of first electrodes on a gas in the discharge space, the pair of first electrodes are comprised of a pair of electrode holders; and an arc discharging step of performing arc discharge with a pair of second electrodes on the gas in which the dielectric barrier discharge has been performed in the dielectric barrier discharge step. the second electrodes are comprised of a pair of electrode rods, wherein the pair of electrode rods are held respectively by the pair of electrode holders so that the first electrodes and the second electrodes are electrically continuous, wherein a dielectric enclosure member covers an outer periphery of the electrode holders wherein the arc discharge is performed downstream from the dielectric barrier discharge in a direction in which the process gas in the discharge space flows, wherein the discharge space includes a gas passage formed in the dielectric enclosure member, wherein the dielectric barrier discharge occurs through the dielectric enclosure member between the pair of electrode holders upstream from the gas passage, and wherein arc discharge occurs between downstream end portions of the pair of electrode rods in a discharge chamber downstream from where the dielectric barrier discharge occurs in the direction in which the process gas in the discharge space flows.

9. A plasma device comprising:

a dielectric barrier discharger configured to perform dielectric barrier discharge on process gas in a discharge space. the dielectric barrier discharger includes a pair of electrodes;

a dielectric enclosure member which includes a pair of dielectric objects each respectively covering a part of an outer periphery of the pair of electrodes facing each other; and a high-frequency power supply configured to apply a high-frequency voltage to the pair of electrodes.

* * * * *